United States Patent [19]

Vaught

[11] Patent Number: 4,751,957

[45] Date of Patent: Jun. 21, 1988

[54] METHOD OF AND APPARATUS FOR CONTINUOUS CASTING OF METAL STRIP

[75] Inventor: Charles F. Vaught, Bethel Park, Pa.

[73] Assignee: National Aluminum Corporation, Pittsburgh, Pa.

[21] Appl. No.: 838,659

[22] Filed: Mar. 11, 1986

[51] Int. Cl.[4] ..... B22D 11/06

[52] U.S. Cl. ..... 164/463; 164/475; 164/488; 164/423; 164/429; 164/437

[58] Field of Search ..... 164/479, 463, 423, 429, 164/475, 485, 488, 437

[56] References Cited

U.S. PATENT DOCUMENTS

| | | | |
|---|---|---|---|
| 3,348,178 | 10/1967 | Erickson et al. . | |
| 3,381,739 | 5/1968 | Hart | 164/474 |
| 3,522,836 | 8/1970 | King . | |
| 3,540,517 | 11/1970 | Wojcik et al. . | |
| 3,605,863 | 9/1971 | King . | |
| 3,642,055 | 2/1972 | Nighman . | |
| 3,812,901 | 5/1974 | Stewart et al. . | |
| 3,823,762 | 7/1974 | Wondris . | |
| 3,857,434 | 12/1974 | Wondris | 164/5 |
| 3,863,700 | 2/1975 | Bedell et al. . | |
| 4,061,177 | 12/1977 | Sivilotti | 164/481 |
| 4,202,404 | 5/1980 | Carlson | 164/423 |
| 4,212,344 | 7/1980 | Uedaira et al. | 164/479 X |
| 4,250,950 | 2/1981 | Buxmann et al. | 164/430 |
| 4,274,473 | 6/1981 | Bedell et al. | 164/423 |
| 4,282,921 | 8/1981 | Liebermann | 164/463 |
| 4,323,419 | 4/1982 | Wakefield | 156/622 |
| 4,337,087 | 6/1982 | Esashi et al. | 75/124 |
| 4,372,369 | 2/1983 | Flemings et al. | 164/482 |
| 4,449,568 | 5/1984 | Narajimham | 164/453 |
| 4,479,528 | 10/1984 | Maringer | 164/423 |

FOREIGN PATENT DOCUMENTS

| | | | |
|---|---|---|---|
| 1364717 | 5/1964 | France . | |
| 58-41656 | 3/1983 | Japan . | |
| 35220 | 8/1985 | Japan | 164/463 |
| 622725 | 4/1981 | Switzerland . | |
| 6630 | of 1908 | United Kingdom . | |
| 20518 | of 1910 | United Kingdom . | |

OTHER PUBLICATIONS

Thornton, J. A. et al., "An Analytical Description of the Jet Finishing Process for Hot-Dip Metallic Coatings on Strip", in *Metallurgical Transactions* B, vol. 78, Dec. 1976, pp. 607–618.

*Primary Examiner*—Nicholas P. Godici
*Assistant Examiner*—Samuel M. Heinrich
*Attorney, Agent, or Firm*—O'Neil and Bean

[57] ABSTRACT

An improved melt drag metal strip casting apparatus and process in which molten metal is delivered from a supply thereof into contact with a cooled casting surface driven at a predetermined linear rate to quench and withdraw a continuous strip of metal from the molten metal supply. An air knife is employed to direct an elongated narrow jet of gas into contact with the top surface of the strip and with the molten metal supply as the strip is withdrawn to impart the desired shape and finish to the top surface of the strip and to control the amount of liquid metal adhering to the top surface as it is withdrawn to thereby control the thickness of the strip.

43 Claims, 2 Drawing Sheets

FIG. 4
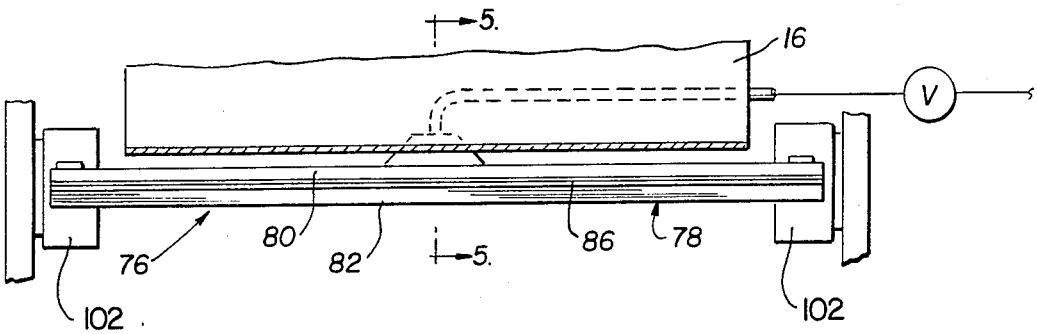
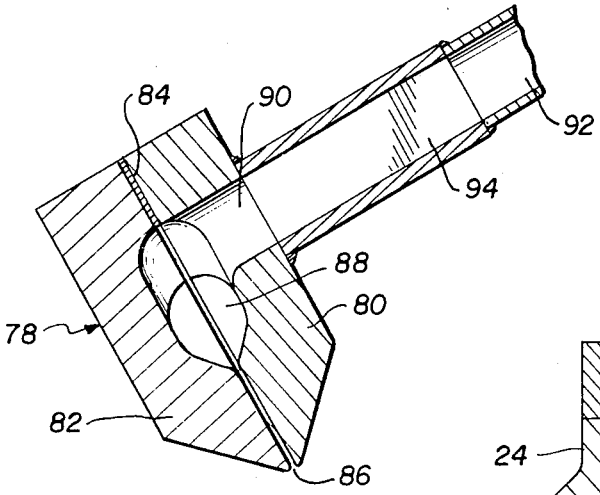
FIG. 5
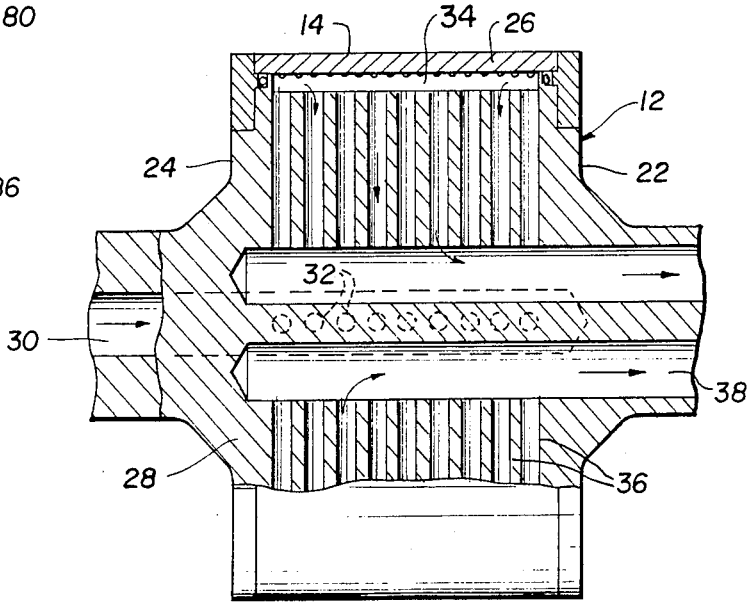
FIG. 6
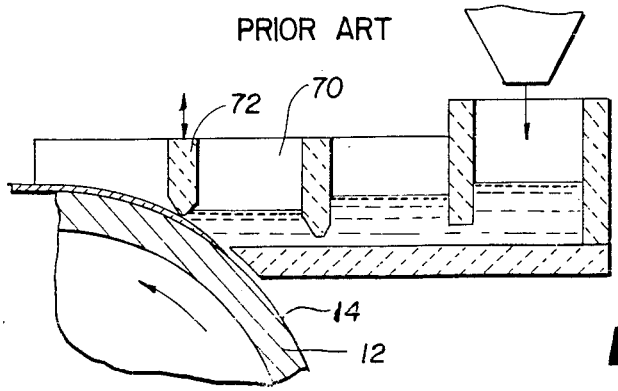
FIG. 7

METHOD OF AND APPARATUS FOR CONTINUOUS CASTING OF METAL STRIP

BACKGROUND OF THE INVENTION

This invention relates to casting of metal sheet or strip, and more particularly to an improved method of and apparatus for the high speed direct casting of thin metal sheet or strip in a continuous or semi-continuous operation.

The metals industry has, for many years, sought to develop a commercially acceptable process for the direct casting of metals into thin sheet or strip (hereinafter, strip) in a semi-continuous or continuous operation. These efforts have been intensified in recent years and substantial research and development has been sponsored both by industry and by various governments. For example, the U.S. Department of Energy has awarded a 2.6 million dollar contract to Westinghouse Electric Corporation and Armco Inc. jointly for development of a roller casting process for forming strip only 3 inches in width, and a 30 million dollar contract to United States Steel Corporation and Bethlehem Steel Corporation jointly for the design and construction of a pilot plant for strip casting.

Efforts to develop a commercially acceptable process for direct casting metal strip have continued throughout most of this century. For example, British patent No. 6,630 discloses the concept of flowing molten metal at a constant rate onto a moving cooled surface to be solidified, and drawing the metal in the form of a thin strip from the cooled surface in a continuous process. Other patents disclosing and describing improvements and variations of this basic concept include, for example, U.S. Pat. Nos. 4,479,528; 4,449,568 and 3,381,736.

A variation of the above concept involves conducting molten metal from a tundish through a restricted outlet so as to provide a convex meniscus at the outlet opening, with the molten metal being drawn from the opening by contacting the meniscus with a moving cooled surface. Examples of patents disclosing this concept include British patent No. 20,518 and U.S. Pat. Nos. 3,522,836 and 3,605,863.

The concept of flowing a stream of molten metal into the nip of a pair of spaced, counter-rotating chilled rolls to produce an elongated strip rolled and chilled on both surfaces is disclosed, for example, in U.S. Pat. Nos. 4,212,344 and 4,337,087 and is described as known prior art in Japanese Published application No. 58-41656.

The use of a chilled roll surface partially submerged in a molten metal bath and driven to withdraw a strip or filament of metal solidified and adhered to the chilled surface is disclosed in U.S. Pat. Nos. 3,540,517 and 3,812,901. The use of a pair of counter-rotating rolls having chilled surfaces partially submerged in a molten metal bath to withdraw a continuous strip through the nip of the rolls is shown in U.S. Pat. Nos. 3,823,762 and 3,857,434.

The use of travelling molds in the form of endless chilled belts or of chilled mold sections connected in caterpillar-track fashion for the continuous casting of metal is also known and is commercially used in the production of plate or thin slabs. Such devices may use a single casting mold or belt as shown in U.S. Pat. Nos. 2,348,178; 3,381,739; 4,274,473; and 4,323,419, or a pair of cooperating endless molds or belts, as shown in U.S. Pat. Nos. 3,642,055 and 4,061,177. The combination of an endless belt or casting mold with a roll contacting the opposed surface of the cast strand is also known as shown, for example, in U.S. Pat. Nos. 4,202,404 and 4,372,368, Swiss patent No. 622,725, and French patent No. 1,364,717.

The use of a gas jet directed onto the free surface of a pool of molten metal to create a standing wave contacting a cooled casting wheel surface is disclosed in U.S. Pat. No. 3,863,700.

It is also known to spray a cooling fluid such as an inert gas or a cooling liquid onto the exposed molten surface of a partially solidified band of metal moving on a chilled casting surface to enable the continuous casting of a thicker gauge plate and to enable subsequent shaping of the exposed top surface by a shaping roll, as illustrated for example in the published Japanese application and the Swiss patent mentioned hereinabove.

U.S. Pat. No. 4,282,921 discloses a process for melt spinning narrow metallic ribbons by directing a jet of molten metal onto a moving chill block surface and directing a gas stream confluent with and surrounding the molten metal jet so that the gas surrounds and bears upon the metal puddle near the point of impingement on the moving chilled surface to stabilize the puddle as the ribbon is formed.

The use of air knives for controlling the thickness of a liquid metal coating on a solid substrate is well known and widely used particularly in hot dip galvanizing and aluminizing of metal strip. Such air knives conventionally include an elongated hollow manifold extending transversely of and in close proximity to the emerging elongated substrate at a point spaced above the coating metal bath. An elongated, narrow nozzle opening extends along the manifold and faces in the direction of the coated substrate. Gas, under pressure, discharged from the nozzle acts as a pressure dam which, depending upon characteristics of the jet including the direction, velocity and mass of the gas and the proximity of the nozzle outlet to the liquid coating material, limits the thickness of the liquid coating carried past the air knife.

In such hot dip metal coating operation, the metal substrate is conventionally passed through a preheating furnace and led directly into the molten metal bath so that the substrate is at a temperature which will maintain the coating in a liquid state for a substantial distance past the air knife, with solidification normally taking place from the exposed coating surface inward. A detailed technical description and analysis of the hot dip metal coating on metal strip is presented by John A. Thornton and Hart F. Graff, *An Analytical Description of the Jet Finishing Process for Hot Dip Metallic Coatings on Strip,* Metallurgical Transactions B, pages 607–618, December 1976.

Despite the continued efforts by the metals industry, applicant is unaware of any previous process which is capable of producing commercially acceptable cast metal strip in a continuous high speed process. It is to be understood that the term "continuous" as used herein is intended to include a semi-continuous direct strip casting operation.

It is the primary object of the present invention to provide an improved process for the direct continuous casting of metal strip.

It is another object of the present invention to provide an improved apparatus and process for continuously producing thin cast metal strip utilizing a melt drag technique.

Another object is to provide apparatus for and method of continuously casting thin metallic strip having a more uniform cross sectional shape and a good top surface finish.

Another object is to provide such a method and apparatus which is capable of high speed production of cast metal strip in a continuous commercial operation.

Another object is to provide a method and apparatus for the high speed casting of metal strip having a thickness which can be varied over a wide range.

Another object is to provide such a method and apparatus for producing cast metal strip which is substantially free of surface defects and inclusions.

The foregoing and other objects and features of the invention are achieved in accordance with the present invention which enables metal strip to be cast from a supply of molten metal by a continuous process wherein the molten metal is brought into contact with a cooled moving casting surface whereby a continuous strand of the metal solidifies on and adheres to the cooled surface to be withdrawn from the molten metal supply. An air knife supported adjacent to the surface of the molten metal supply directs a thin low pressure air jet into contact with the surfaces of the molten metal supply and the emerging strand at the point of emergence of the solidifying strand. The position and direction of the fluid jet, the shape of the outlet nozzle and the gas pressure are controlled to shape the free surface of the strand as it exits from the molten metal supply and to prevent oxides, slag or other material on the molten metal supply surface from adhering to liquid metal on the surface of the strand while at the same time controlling strip thickness and strip profile by limiting the amount and distribution of liquid metal adhering to the free top surface of the partially solidified strand.

In accordance with a preferred embodiment of the invention, the casting surface is the cylindrical outer surface of a casting wheel or drum which is supported and driven for rotation about a fixed horizontal axis. A tundish supported adjacent to the casting wheel has an open end contoured to fit in close conformity with and be effectively closed by a portion of the casting wheel surface. Molten metal is continuously supplied to the tundish to maintain a substantially constant depth of molten metal in contact with the rotating chilled casting surface. As the casting surface moves upward through the molten metal the metal wets and adheres to the chilled surface and is quickly solidified, with the solidified strand increasing in thickness progressively until it emerges from the top surface of the metal in the tundish.

A gas discharge nozzle assembly, hereinafter referred to an an air knife, is supported above the surface of the metal in the tundish and has an elongated nozzle outlet positioned and oriented to direct a low speed jet of gas onto the molten metal surface along the line of intersection of the surface of the molten metal and the casting surface, i.e., the point at which the strand emerges from the molten metal. The gas jet establishes a depression in the surface of the molten metal in the tundish adjacent to the emerging strand and produces a standing wave adjacent to the depression. This standing wave and the gas from the jet sweeping over its surface prevent oxides, slag and other material on the molten metal surface from contacting the exposed wet surface of the emerging strand adhering to and moving with the cooled casting surface.

The fluid jet has a component of motion generally perpendicular to the exposed surface of the strand at the point of emergence from the molten metal in the tundish. At this point, the strand is substantially solidified, but the exposed top surface has a layer of liquid metal adhering thereto. The velocity, mass and direction of the gas in the jet are controlled so that the gas acts upon and shapes this liquid layer to produce the desired cross-sectional shape and surface finish. The jet is also effective to limit the thickness of the liquid layer and to this extent the thickness of the strand. As previously stated, however, the emerging strand is solidified throughout at least a major portion of its thickness and the final strip thickness will be determined by a combination of factors.

The chilled casting wheel surface rapidly quenches the metal contacting the surface so that the strand is completely solidified very quickly after passing beyond the jet from the air knife. Thus, the top surface finish and shape imparted to the strip by the controlled jet is maintained as a result of the rapid solidification. Strip thickness can also be varied independently of the air knife by varying the time of exposure of the molten metal to the chilled casting wheel surface by either varying the speed of the casting wheel or the length of the wheel surface which at any given time is exposed to the molten metal in the tundish.

Other features and advantages of the invention will be apparent from the detailed description contained hereinbelow, taken in conjunction with the drawings, in which:

FIG. 4 is a view taken along lines 4—4 of FIG. 1 and showing the air knife assembly;

FIG. 5 is an enlarged sectional view taken along lines 5—5 of FIG. 4;

FIG. 6 is a sectional view taken along lines 6—6 of FIG. 1; and

FIG. 7 is a view similar to FIG. 2 and showing a prior art strip casting apparatus;

Figure 1:
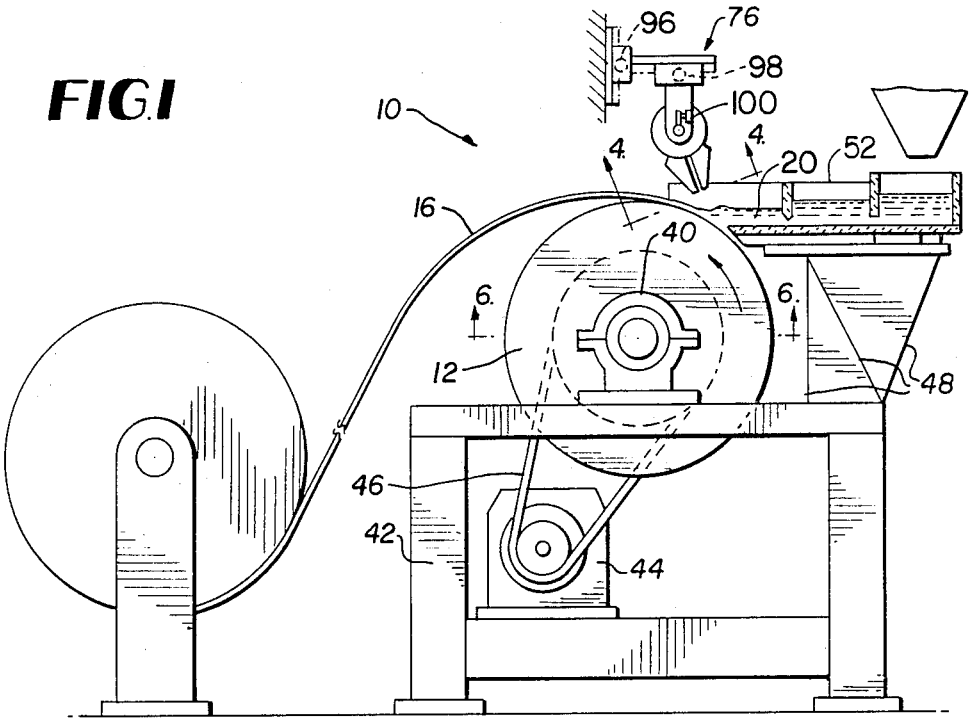
FIG. 1 is a schematic elevation view, partially in section, of a strip casting apparatus according to the present invention.

Referring now to the drawings in detail, a melt drag strip casting apparatus embodying the present invention is illustrated schematically in FIG. 1 and designated generally by the reference numeral 10. In this embodiment of the invention, the apparatus includes a casting wheel or drum 12 having a cylindrical, cooled outer surface 14 upon which the metallic strip 16 is cast. A tundish assembly 18 is supported in close proximity to the casting wheel 12 in position to contain a supply of molten metal 20 and to maintain a uniform depth of the molten metal in contact with the casting surface 14 of wheel 12.

In the preferred embodiment of the invention, the casting wheel 12 is internally cooled with circulating water or other cooling fluid to rapidly extract heat through the peripheral surface 14 to rapidly quench and solidify liquid metal contacting the peripheral casting surface as the surface rotates upward through the molten metal supply 20 in tundish 18. Internally cooled casting drums are known, for example from U.S. Pat. No. 2,348,178, and as schematically illustrated in FIG. 6 may comprise a hollow drum made up of a pair of end flanges 22, 24 and an outer peripheral rim 26, the outer surface of which defines the external casting surface 14.

A central hub 28 supported within the hollow drum has axially and radially extending connecting inlet passages 30, 32, respectively, communicating with the annular space 34 between hub 28 and outer rim 26, and radially and axially extending connecting passages 36, 38 communicating with the annular space 34 to provide an outlet for cooling water.

The rim 26 of casting wheel 12 may be formed of any suitable metal material having a sufficiently high and uniform thermal conductivity and good wear resistance. For example, casting wheels having a casting surface of copper, steel, and aluminum and alloys of these metals have been successfully employed for the high speed casting of strip metal in the apparatus of FIGS. 1–6. The casting surface 14 may be substantially smooth but preferably is mechanically roughened or grooved as suggested in U.S. Pat. No. 4,250,950 or French patent No. 1,364,717. Suitable bearings 40 support the wheel 12 for rotation about a fixed horizontal axis on a rigid support frame structure indicated in FIG. 1 by the reference numeral 42. Suitable variable speed drive means, such as an electric motor, not shown, acting through a reduction gear mechanism 44 and a drive chain 46 drives wheel 12 at the desired speed about its fixed axis. Other suitable drive means may, of course, be employed instead of the schematically illustrated chain drive.

The tundish 18 is supported in fixed relation to casting wheel 12 by suitable frame structure illustrated schematically at 48. The tundish is constructed from a high strength, thermally insulating material such as a cast ceramic material, or a rigid metal frame structure lined with a suitable refractory material, to minimize heat loss from the molten metal supply 20 contained within the tundish during operation. In the illustrated embodiment, the tundish is made up of a substantially flat horizontally extending bottom wall 50, a pair of spaced upward extending side walls 52, 53 and an end wall 54, with the end of the tundish opposite end 54 being open to permit the molten metal 20 to flow into direct contact with the adjacent outer peripheral surface 14 of wheel 12. Thus, the wheel 12 acts as a wall or dam to prevent the flow of molten metal out of the open end of the tundish. The end of bottom wall 50, and portions of the ends of side walls 52–53 are contoured to closely conform to the contour of peripheral surface 14, with the spacing between the tundish bottom walls and side walls and the wheel surface 14 being so small as to prevent the flow of liquid metal therebetween. In practice, it has been found that a spacing of about 0.10 to 1.00 mm. between surface 14 and the adjacent tundish structure is satisfactory.

A transverse partition wall 60 having its bottom edge spaced above the top surface of bottom wall 50 is located in the tundish in spaced relation to end wall 54 to define a receiving chamber 62 for receiving molten metal from a suitable source such as a ladle or runner indicated generally at 64. A vertically movable transverse wall or weir 66 also extends between side walls 52, 53 at a location between the fixed wall 60 and the open end of the tundish, and cooperates with side walls 52, 53 and partition wall 60 to define a surge chamber 68. The bottom edge of wall 66 is spaced above the top surface of bottom wall 50 during operation of the apparatus for casting strip to permit a controlled flow of liquid metal therebeneath to maintain a substantially uniform level of metal in the casting chamber 70. Suitable means, not shown, is provided for vertically adjusting the position of wall 66 in response to the continuously sensed level of metal in casting chamber 70 to maintain the desired uniform depth of metal in chamber 70.

Figure 3:
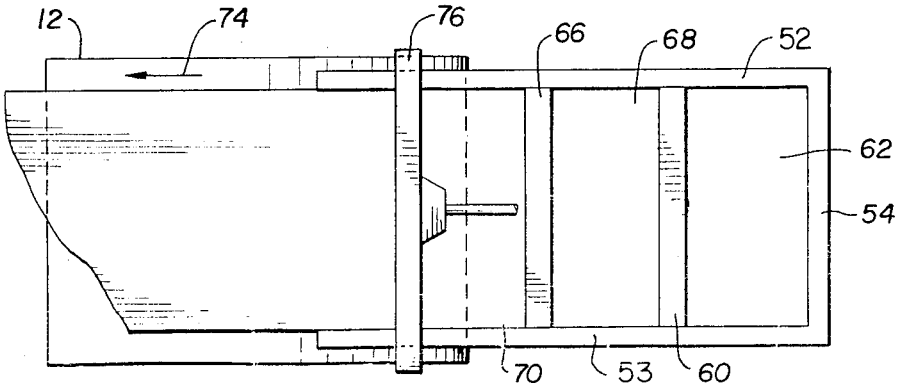
FIG. 3 is a top plan view of the apparatus shown in FIG. 2.

As most clearly seen in FIG. 3, with the casting wheel 12 being driven in the direction indicated by the arrow 74, a clean cool area of the outer peripheral casting surface 14 will continuously be presented at the bottom portion of casting chamber 70 and move progressively upward through the molten metal in the chamber. Since the surface 14 is cooled from the circulating cooling fluid inside the casting wheel, the molten metal which initially wets the surface as it enters the bottom of the casting chamber is immediately quenched and solidified, with heat extraction continuing and the thickness of the solidified strand adhering to the surface 14 progressively increases throughout the path through the molten metal in chamber 70 to the point of emergence from the top surface of the molten metal, thereby progressively withdrawing metal from the chamber 70 at a substantially uniform rate. The withdrawn metal is replaced, at an equal rate, beneath the bottom edge of the movable wall 66 from the surge chamber 68. The rate of flow beneath the metering wall 66 will, of course, depend upon the fluid head between the surge chamber 68 and the casting chamber 70 and the vertical position of wall 66 required to maintain a constant depth of metal in chamber 70 will therefore vary in response to changes in the level of metal in the surge chamber 68. Other arrangements could, of course, be provided for maintaining the desired depth of metal in the casting chamber.

With a uniform flow of metal into the casting chamber 70, the level of metal in surge chamber 68 will depend upon the level of metal in the receiving chamber since the rate of flow beneath the fixed wall 60 will also depend upon the difference in the level of metal in the surge chamber 68 and in the receiving chamber 62.

Molten metal flowing into receiving chamber 62 from the open top can result in substantial turbulence in this chamber. Also, any slag, dross, oxides or other material normally floating on the surface of metal in the receiving chamber may be entrained in the incoming stream of metal and be mixed with the molten metal in the chamber. Thus, a greater depth of metal is desired in the receiving chamber to permit any such entrained material to migrate back to the top surface of the molten metal rather than to be carried beneath the wall 60 into the surge chamber 68. Also, by maintaining an excess of material in receiving chamber 62, an empty supply ladle 64 may be removed and replaced without interrupting the casting operation.

The apparatus and process thus far described are substantially identical to the prior art apparatus and process illustrated in FIG. 7. As shown in FIG. 7, however, this known system employs a submerged metering weir 72 which acts somewhat in the nature of a squeegee or doctor blade to control the amount of liquid or congealing, semi-solid metal withdrawn from the molten metal bath on the casting wheel. Metering weir 72 has its lower contoured edge surface submerged in the molten metal in casting chamber 70 an is supported for adjustment both vertically and horizontally to control both the thickness of the strand withdrawn from the metal bath and the length, in the direction of rotation, of the casting surface 14 exposed to the molten metal supply at any instant.

While the prior art melt drag system illustrated in FIG. 7 may be operated to cast metal strip, such systems generally have not been commercially acceptable for high speed casting of thin, wide metal strip. For example, in a high speed casting operation the abrasive action of the molten metal tends to quickly wear the critical surface of the metering weir. Further, any slag, dross or other material on the surface of the molten metal in the casting chamber tends to be drawn beneath the weir to adhere to the surface of the cast strand, or to be embedded in the strand. Such material also tends to produce uneven wear on the metering edge of the weir or to adhere to the weir surface and produce an unacceptable top surface finish on the strip or to produce unacceptable variations in thickness longitudinally of the strip and in transverse thickness profile. Other prior art systems employing a metering nozzle or the like suffer from the same drawbacks.

In accordance with the present invention, an air knife assembly, indicated generally at 76, is employed in place of the metering weir of the prior art apparatus shown in FIG. 7. The construction of nozzle assembly 76 may be similar to that conventionally employed in hot dip coating of strip metal such as a galvanizing or aluminizing operation. Thus, as shown in FIGS. 1–5, the nozzle assembly 76 comprises an elongated manifold structure 78 extending transversely of tundish 18, with the manifold being made up of a pair of opposed die members 80, 82 retained in assembled relation by bolts, not shown, extending through openings along the closed back and end portions of the manifold. A thin, dimensionally stable shim member 84 is positioned between the two die members and extends along the end and back walls, thereby providing an elongated thin outlet nozzle 86 communicating with the hollow interior or plenum chamber 88 defined by recesses in the opposing surface of the two die members. The interior walls of the plenum chamber preferably are smooth and contoured to provide a substantially uniform gas pressure and flow rate through outlet nozzle 86 along the full length of the outlet. This flow rate, however, can be varied along the length of outlet 86 to provide the desired shape or top surface profile across the width of the cast strip. This may be accomplished by contouring the surfaces of the two die members defining the outlet opening to provide slight variations in outlet dimensions along the nozzle length. Also, shims 84 of different thicknesses may be employed to vary the flow rate from the nozzle assembly, and the thickness of the shim may be varied along the length of the manifold assembly, with the connecting bolts deflecting the dies sufficiently to conform to the shim thickness to control the shape of the outlet nozzle and thereby the jet of gaseous fluid discharged from the nozzle outlet. By producing an increased gas flow from the outlet 86 adjacent the side edges of the strip 16, the strip thickness can be slightly reduced in this area to facilitate coiling and to produce a more desirable strip thickness profile for any subsequent rolling required.

An inlet opening 90 formed in the die member 80 communicates with a fluid supply conduit 92, preferably through a diffuser section 94 rigidly joined, as by welding, to the die member 80. Alternatively, the inlet may be at another location such as the back or end of the manifold assembly and plural inlets may be employed if desired.

As shown in FIG. 1, air knife assembly 76 is supported above casting wheel 12 with the outlet nozzle 86 extending in parallel relation to the axis of the casting wheel and spaced from the casting surface 14. Suitable means such as the schematically illustrated adjustable rack and pinion support block 96 supports the nozzle assembly for vertical movement and a second schematically illustrated rack and pinion assembly 98 supports the nozzle for horizontal movement in a plane parallel to the top surface of the molten liquid in tundish 18. Third adjusting means, such as the schematically illustrated adjusting screw 100 is provided for rotating the nozzle assembly about its horizontal support axis in the support brackets 102.

In operation of the system, gas is supplied to the plenum chamber at a relatively low pressure, with the volume of the plenum chamber being sufficient to assure that pressure within the chamber is substantially uniform throughout in order to provide the desired, carefully controlled flow through the narrow outlet nozzle 86. Preferably an inert gas such as nitrogen or argon is employed to avoid oxidation of the hot metal by the jet, although air or steam may be employed for casting some metals. In casting metals such as aluminum having a high affinity for oxygen, a hood may be placed over the tundish 18 and an inert gas circulated through the hood.

Figure 2:
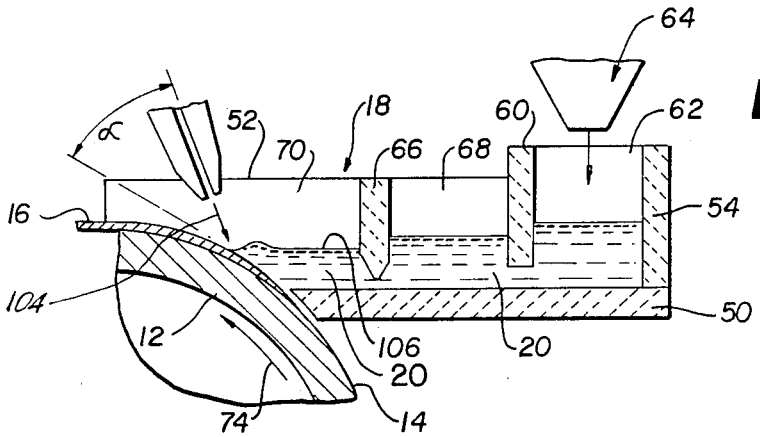
FIG. 2 is an enlarged fragmentary sectional view, in elevation, of a portion of the apparatus shown in FIG. 1.

As shown in FIG. 2, the gas jet issuing from nozzle 86 is directed along a plane indicated at 104 which intersects the surface of the emerging strip 16 at an acute angle $\alpha$ with a plane tangent to the strip adhering to the casting wheel, the angle $\alpha$ being measured on the side of the jet opposite the casting pool 20. Also, the line 104 intersects the emerging strip surface at a point slightly below the normal top surface 106 of the molten metal in the casting chamber 70. This arrangement results in a component of force from the gas jet extending perpendicular to the emerging strip 16 and a second component in a direction generally parallel to the molten metal surface 106, with the result that the impinging gas jet tends to be deflected in the direction of casting chamber 70.

At the point of impingement of the gas jet onto the emerging solidifying strip, the strip has an upwardly directed (top) liquid surface, i.e., a surface which is wet with liquid metal being carried by momentum of the strip from the pool whereas the bottom surface contacting the casting surface 14 is completely solidified. At this point, the strip beneath the liquid surface is still very hot and soft so that the shear force from the jet must be kept sufficiently low and controlled to avoid damage to the surface. At the same time, the jet must maintain proper control of the boundary between the issuing strip and the casting pool from which the solid strip is issuing. By directing the jet to a point slightly below the casting pool surface at its forward edge, i.e., the edge adjacent the issuing strand, the gas pressure may be controlled to create a stable standing wave at the casting pool surface and the backward sweeping angle of the jet causes the gas to sweep over the molten metal surface of the wave. This flow of gas effectively sweeps oxides, slag, and the like away from the issuing strand with the result that the cast strip is substantially free from inclusions and surface adhesions.

It has been found that relatively low pressures are required in the air knife plenum chamber to produce good strip surface and thickness profile on strip cast using the above-described apparatus. Pressures of about 4 to about 70 gm. per sq. cm. have been successfully used in the casting of aluminum, with somewhat higher pressures being acceptable for some heavier metals such as steel. The optimum gas pressure will vary somewhat with other factors including the vertical position of the outlet nozzle 86 and the angle of the jet relative to the casting pool surface, the angle $\alpha$, the depth of the casting pool, and the position of the casting pool on the casting wheel. Depending on these factors as well as the type of metal cast, gas pressure between about 3 and 400 gm. per sq. cm. may be used.

In the configuration of the invention described above, the top surface of the casting pool is located between the three and twelve o'clock positions on the casting wheel (as viewed in the drawings), with the tundish lip, i.e., the top surface edge of bottom wall 50 normally being located between the one o'clock and two o'clock positions. The ideal location of the casting pool will also depend on various factors and conditions including the metal being cast, the diameter and speed of the casting wheel, the depth of metal in the casting pool and the desired thickness of the strip cast.

The speed of the casting surface will effect both the thickness of the strip to be cast and the tendency of the liquid metal to be carried from the casting pool, on the solidifying strip surface. Casting speed will, therefore, also affect the angle $\alpha$ and/or the gas pressure required to produce the necessary component of force from the jet in a direction normal to the surface of the emerging strip at the point of emergence to limit the amount of momentum liquid carried from the pool. The angle $\alpha$ and the gas pressure will also affect the standing wave established in the surface of the casting pool. Thus, for any given casting wheel speed, the horizontal and vertical position of the air knife and the angular direction of the jet must be coordinated with the depth of metal in the casting pool, the operating gas pressure in the air knife plenum chamber, and the location of the tundish lip around the periphery of the casting wheel surface to produce a stable standing wave in the casting pool surface and maintain the desired thickness, profile, and top surface condition on the emerging strip.

Casting speed and casting pool depth also influence the point of release of the cast strip from the casting surface. If casting speed is too slow for the casting pool depth, thermal contraction of the solidifying strand can result in release prior to emerging from the casting pool and cause uneven or uncontrolled surface thickness or even remelting and breaking of the strand. On the other hand, excessive casting wheel speed can result in insufficient solidification time and an unfavorably high ratio of liquid-to-solid product emerging from the casting pool, whereby the capability for process control may be impaired or lost.

The apparatus described above has been employed to successfully cast steel and aluminum strip over a wide range of casting speeds. Further, by controlling the pressure within the air knife plenum chamber and the other parameters as discussed above, it has been demonstrated that strip having a thickness varying over a wide range can be produced at speeds throughout the range tested, and good strip quality and surface finish have been achieved at various casting speeds. Strip thicknesses may vary from about 0.005 mm. to more than 10.0 mm. and casting speed may be in the range of from about 0.25 to about 30 meters per second.

Numerous trial runs have also been made employing casting wheels having casting surfaces of different materials and surface characteristics. Casting surfaces made of copper, copper-1% chromium alloy, steel and aluminum alloy have been employed, and both smooth and roughened or grooved casting wheel surfaces have been used. Metals cast during these trial runs have included aluminum alloys A356.2, 1100 and 3105, OFHC copper and low carbon steel.

Experimental runs have also been made to evaluate the effect of casting speeds, casting pool depth, i.e., the length of casting wheel surface in contact with the molten metal, air knife position and gas pressure, variations in angle $\alpha$, and other variables as discussed hereinabove. The examples contained in Table 1 below illustrate some of various experimental runs which have been made employing the invention.

TABLE 1

AIR KNIFE RUNS

| Run No. | Metal Cast | Wheel Surface | Casting Speed (m/sec) | Strip Thickness (mm) | Strip Width (cm) | Air Knife Pressure (g/sq. cm) | Air Knife Angle ($\alpha$) |
|---|---|---|---|---|---|---|---|
| 94 | 3105Al | Cu | 2.98 | .63 | 25.4 | 85 | 45°–50° |
| 97 | 3105Al | Cu | 2.98 | 0.61–0.81 | 25.4 | 17.36 | 52° |
| 99 | 3105Al | Cu | 2.98 | 0.56–0.61 | 25.4 | 13.02 | 50° |
| 101 | 3105Al | Cu | 3.35 | 0.51–0.74 | 25.4 | 8.68 | 45° |
| 102 | 3105Al | Cu | 3.35 | 0.46 | 25.4 | 28–78 | approx. 53° |
| 105 | 3105Al | Cu | 3.35 | 0.56–0.79 | 25.4 | 30.38 | 42° |
| 119 | Steel | Cu—Cr | 2.00 | 0.54 | 14 | 57 | not recorded |
| 122 | 3105Al | Steel | 1.12 | .32 | 12.7 | 140–280 | 25° |
| 123 | 3105Al | Al | 1.12 | .32 | 12.7 | 140–280 | 25° |

Experimental runs have also been made utilizing apparatus in which a metering weir was employed instead of the air knife, as illustrated in FIG. 7, but these runs did not produce an acceptable cast strip. For example, strip produced on this prior art apparatus frequently had excessive inclusions and surface adhesions, uneven thickness profile and surface damages resulting from uneven wear on the metering weir. Conversely, strip produced in accordance with the present invention is of a quality adequate for some end uses such as the production of building and rain products and the like without further processing, and it may readily be further processed by rolling since it is substantially free of inclusions and surface adhesions.

While a preferred embodiment of the invention has been disclosed and described, it should be understood that the invention is not so limited and that it is intended to include all embodiments which would be apparent to one skilled in the art which come within the spirit and scope of the invention.

What is claimed:

1. A process for continuously casting metal strip comprising, providing a cooled continuous casting surface, providing a supply of molten metal and bringing the molten metal from the supply into contact with a predetermined area of the casting surface at a casting station, quenching the molten metal contacting the casting surface by extracting heat therefrom through the casting surface to solidify a strand of metal of predetermined thickness and driving the casting surface in a continuous path past the casting station to withdraw from the molten metal supply the solidified strand and a layer of molten metal adhering to the exposed surface of the strand, continuously directing a thin jet of gas onto the layer of molten metal across the full width of the strand substantially contemporaneously with withdrawal of the strand from the molten metal supply to shape the surface of the layer of molten metal and to control the thickness of the strand, and continuing to quench the strand by extracting heat through the casting surface, to solidify the layer of molten metal downstream of the gas jet.

2. The process defined in claim 1 wherein the molten metal supply has a free surface in a plane intersecting the casting surface and the strand withdrawn thereon, and the casting surface is driven to withdraw the strand and the layer of molten metal from the free surface of the molten metal supply.

3. The process defined in claim 2 wherein the gas jet is directed onto the free surface of the metal supply and the layer of molten metal along the line of intersection of the free surface and the strand being withdrawn.

4. The process defined in claim 3 further comprising the step of controlling the gas jet to impart the desired shape and finish to the surface of the layer of molten metal on the strand.

5. The process defined in claim 4 wherein the step of controlling the gas jet includes controlling the gas pressure and direction of the jet to establish a standing wave in the free surface adjacent the casting surface.

6. The process defined in claim 5 wherein the step of directing a jet of gas onto the layer of molten metal comprises supporting an air knife adjacent to the free surface of the molten metal, said air knife having an elongated outlet nozzle extending generally parallel to and spaced from the line of intersection of the free surface and the casting surface, and supplying gas under pressure to the air knife to be discharged from the outlet.

7. The process defined in claim 6 wherein the air knife is supported for limited rotation about an axis parallel to the line of intersection of the free surface and casting surface and for translation toward and away from said free surface, and wherein the step of controlling said jet further comprises the step of adjusting the position of the air knife to thereby adjust the angle of said jet and the velocity of the gas in the jet at the point of impact with the molten metal.

8. The process defined in claim 7 wherein said outlet is shaped to produce an increased gas flow adjacent the side edges of the strand emerging from the molten metal supply.

9. The process defined in claim 8 wherein the pressure of gas supplied to said air knife is within the range of from about 3 to about 400 gm. per sq. cm.

10. The process defined in claim 8 wherein the metal cast is aluminum or an aluminum alloy and when the pressure of gas supplied to said air knife is within the range of about 4 to about 70 gm. per sq. cm.

11. The process defined in claim 10 wherein the linear rate of movement of said casting surface is within the range of about 0.25 to about 30 meters per sec.

12. The process defined in claim 11 wherein the thickness of the strip cast is within the range of about 0.005 to about 10.0 mm.

13. The process defined in claim 1 wherein said casting surface is the outer cylindrical surface of an internally cooled casting wheel mounted for rotation about a horizontal axis, and wherein the step of driving said casting surface comprises driving the casting wheel for rotation about said axis at a substantially uniform rate.

14. The process defined in claim 13 wherein said tundish has an opening in one wall, said casting surface being positioned closely adjacent to and sealing said opening in said wall, the molten metal in the tundish contacting the casting surface through the opening in the one wall.

15. The process defined in claim 14 wherein the molten metal supply has a free surface in a plane intersecting the casting surface and the strand withdrawn thereon, and the casting surface is driven to withdraw the strand and the layer of molten metal from the free surface of the molten metal supply.

16. The process defined in claim 15 wherein the gas jet is directed onto the free surface of the metal supply and the layer of molten metal along the line of intersection of the free surface and the strand being withdrawn.

17. The process defined in claim 16 further comprising the step of controlling the gas jet to impart the desired shape and finish to the surface of the layer of molten metal on the strand.

18. The process defined in claim 17 wherein the step of controlling the gas jet includes controlling the velocity and direction of the jet to establish a standing wave in the free surface adjacent the casting surface.

19. The process defined in claim 18 wherein the step of directing a jet of gas onto the layer of molten metal comprises supporting an air knife adjacent to the free surface of the molten metal, said air knife having an elongated outlet nozzle extending generally parallel to and spaced from the line of intersection of the free surface and the casting surface, and supplying gas under pressure to the air knife to be discharged from the outlet.

20. The process defined in claim 19 wherein the step of controlling the jet comprises controlling the gas pressure to the air knife to thereby control the velocity of the gas in the jet.

21. The process defined in claim 20 wherein the air knife is supported for limited rotation about an axis parallel to the line of intersection of the free surface and casting surface and for translation toward and away from said free surface, and wherein the step of controlling said jet further comprises the step of adjusting the position of the air knife to thereby adjust the angle of said jet and the velocity of the gas in the jet at the point of impact with the molten metal.

22. The process defined in claim 21 wherein the pressure of gas supplied to said air knife is within the range of from about 3 to about 400 gm. per sq. cm.

23. The process defined in claim 21 wherein the metal cast is aluminum or an aluminum alloy and wherein the pressure of gas supplied to said air knife is within the range of about 4 to about 70 gm. per sq. cm.

24. The process defined in claim 23 wherein the linear rate of movement of said casting surface is within the range of about 0.25 to about 30 meters per sec.

25. The process defined in claim 24 wherein the thickness of the strip cast is within the range of about 0.005 to about 10.0 mm.

26. The process defined in claim 19 wherein said jet is directed in a plane extending at an acute angle $\alpha$ relative to a plane tangent to the free top surface of a strand being withdrawn at the line of intersection with the plane of the free surface of the molten metal supply.

27. The process defined in claim 26 wherein the air knife is supported for limited rotation about a horizontal axis parallel to the axis of said casting wheel whereby the angle $\alpha$ may be adjusted.

28. The process defined in claim 27 wherein said outlet is shaped to produce an increased gas flow adjacent the side edges of the strand emerging from the molten metal supply.

29. The process defined in claim 28 further comprising adjusting the angle $\alpha$ and controlling the gas pressure of said jet to thereby control the thickness of the layer of molten metal adhering to the strand withdrawn on the casting surface.

30. In a melt drag metal strip casting apparatus wherein molten metal is delivered from a supply of molten metal into contact with a cooled casting surface at a casting station and the casting surface is driven for movement in a path past the casting station at a predetermined linear rate to quench and withdraw a continuous strand of metal from the molten metal supply, the strand having a bottom surface adhering to the casting surface and an exposed top surface as it is withdrawn, the improvement comprising, air knife means, mounting means supporting said air knife means adjacent to said casting station, said air knife means including a manifold having an elongated narrow outlet positioned to direct a thin jet of gas onto the surface of the molten metal supply adjacent to said casting surface and onto the top surface of the strand across the full width of the strand and substantially confluent with the emergence of the strand from the molten metal supply, and means for supplying a gas under pressure to said air knife manifold to be discharged as said jet of gas from said outlet, said jet having sufficient force and being shaped to impart the desired shape and finish to the top surface of the strand as the strand is withdrawn from the supply of molten metal and to limit the amount of liquid metal adhering to the top surface of the strand to thereby control the thickness of the strip cast.

31. The apparatus defined in claim 30 wherein said mounting means comprises means supporting said manifold for limited rotation about a first horizontal axis extending transversely of and parallel to said strand at the point of withdrawal of the strand from the supply of molten metal, and means for adjusting the position of said manifold about said first axis whereby the direction of said jet may be adjusted relative to said top surface.

32. The apparatus defined in claim 31 wherein said mounting means further comprises means supporting said manifold for limited translation in a direction substantially perpendicular to said first axis whereby the position of said outlet may be adjusted relative to said strand.

33. The apparatus defined in claim 30 further comprising a tundish for containing said supply of molten metal, said tundish being supported in closely spaced relation to said cooled casting surface and having an opening in one wall through which molten metal is conducted into contact with said cooled casting surface, and wherein molten metal contained in said tundish has a free top surface contacting the top surface of a strand being withdrawn on said cooled casting surface.

34. The apparatus defined in claim 33 wherein said gas jet is directed onto said free top surface of the supply of molten metal and said top surface of said strand along the line of intersection thereof.

35. The apparatus defined in claim 34 wherein said outlet is contoured to provide a jet of gas having an increased gas flow adjacent the side edges of said strand.

36. The apparatus defined in claim 34 wherein said cooled casting surface comprises the outer metallic surface of a casting wheel mounted for rotation about a second horizontal axis parallel to said first horizontal axis.

37. The apparatus defined in claim 36 wherein said casting wheel is an internally cooled wheel.

38. The apparatus defined in claim 37 wherein said casting surface is a substantially smooth surface.

39. The apparatus defined in claim 37 wherein said casting surface is grooved.

40. The apparatus defined in claim 37 wherein said mounting means comprises means supporting said manifold for limited rotation about a first horizontal axis extending transversely of and parallel to said strand at the point of withdrawal of the strand from the supply of molten metal, and means for adjusting the position of said manifold about said first axis whereby the direction of said jet may be adjusted relative to said top surface.

41. The apparatus defined in claim 40 wherein said mounting means further comprises means supporting said manifold for limited translation in a direction substantially perpendicular to said first axis whereby the position of said outlet may be adjusted relative to said strand.

42. The apparatus defined in claim 34 wherein said outlet is contoured to provide a jet of gas having a variable gas flow and jet pressure along the length of said outlet.

43. The process defined in claim 7 wherein said outlet is shaped to produce a variable gas flow and jet pressure along the length of the outlet to thereby control the transverse thickness profile of the strand emerging from the molten metal supply.

* * * * *